United States Patent [19]

Gibson

[11] 4,060,232

[45] Nov. 29, 1977

[54] CONTROLLED SLIP PAPER SEPARATOR

[75] Inventor: David Kent Gibson, Boulder, Colo.

[73] Assignee: International Business Machines Corporation, Armonk, N.Y.

[21] Appl. No.: 741,426

[22] Filed: Nov. 12, 1976

[51] Int. Cl.[2] ..... B65H 3/46

[52] U.S. Cl. ..... 271/122

[58] Field of Search ..... 271/10, 34, 35, 122, 271/125

[56] References Cited

U.S. PATENT DOCUMENTS

| | | | |
|---|---|---|---|
| 408,405 | 8/1889 | Dolphin | 271/122 |
| 2,892,629 | 6/1959 | Osgood, Jr. et al. | 271/122 |
| 3,272,500 | 9/1966 | van Dalen et al. | 271/34 |
| 3,556,512 | 1/1971 | Fackler | 271/122 UX |
| 3,754,754 | 8/1973 | Peterson | 271/122 |
| 3,825,248 | 7/1974 | Friend | 271/10 |
| 3,885,782 | 5/1975 | Wright et al. | 271/10 |
| 3,895,790 | 7/1975 | Hoyer et al. | 271/10 |

*Primary Examiner*—Robert W. Saifer
*Attorney, Agent, or Firm*—Charles E. Rohrer

[57] ABSTRACT

Sheet separating apparatus to pass sheets one at a time, comprising a nip formed by a positively driven separator roll and a retard roll. Pulleys are located on the shafts of the two rolls and a continuous garter spring is placed around the pulleys. When one sheet is in the nip, slippage occurs between the garter spring and the pulleys; when multiple sheets are in the nip, slippage occurs between the sheets and the retard roll is driven by the garter spring.

1 Claim, 3 Drawing Figures

CONTROLLED SLIP PAPER SEPARATOR

This invention relates to sheet feeding devices and more particularly to a device for feeding sheets, one at a time, from a stack of sheets.

BACKGROUND OF THE INVENTION

The problem of separating and feeding sheets one at a time from a stack of sheets has been the subject of considerable development effort and considerable patent activity. Cheap, simple, and efficient solutions to the problem of multiple-sheet feeds have long been sought and even where expensive solutions are provided, the reliability of the sheet separating apparatus has never been perfect.

One of the most common types of paper feeding and separating apparatus calls for providing a mating pair of rollers through which the paper is fed. U.S. Pat. No. 2,892,629 shows an arrangement in which one of the two rollers between which the sheets pass is positively driven but the other roller is a retard roller and is not positively driven. The latter roller is freely rotatable on a shaft and is spring urged to turn in a direction opposite to that of the positively driven roller. When only one sheet is passing between the two rollers, the friction is such as to cause the retard roller to turn in the direction of motion of the sheet and against the spring bias. However, when two sheets are disposed between the two rollers, the first sheet, bearing against the positively driven roller, is advanced while the second sheet is moved to the rear, under the influence of the spring biased retard roller which now rotates in the opposite direction to sheet transfer. U.S. Pat. Nos. 3,895,790 and 3,895,782 also use the retard roller arrangement in which the retard roller is reversed when a multiple feed occurs. These prior art devices use a slip clutch system to provide forward movement when a multiple feed is not present. All of these devices depend upon the relative friction between the positively driven roller and the sheet to be advanced as being greater than the friction between the sheet to be advanced and the sheet or sheets to be returned.

It is the primary object of this invention to make use of the positively driven roller and retard roller scheme in a new and improved apparatus for the separation of multiplefed sheets in order to provide a device in which sheets are reliably fed one at a time.

SUMMARY OF THE INVENTION

A garter spring drive is used to rotate a retard roll in a sheet reversing direction when multiple sheets are in a nip formed by the retard roll and a positively driven separator roll. When one sheet is in the nip, slippage occurs between the garter spring and pulleys so that the retard roll turns with the separator roll in a paper feed direction.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

The problem of multiple-sheet feeding is obviously apparent in a document copier machine where it is necessary to feed the copy paper one sheet at a time from a supply tray in order that a copy of the original document can be placed on the copy paper. If a multiple-sheet feed occurs, a paper jam will result, causing machine failure.

Figure 1:
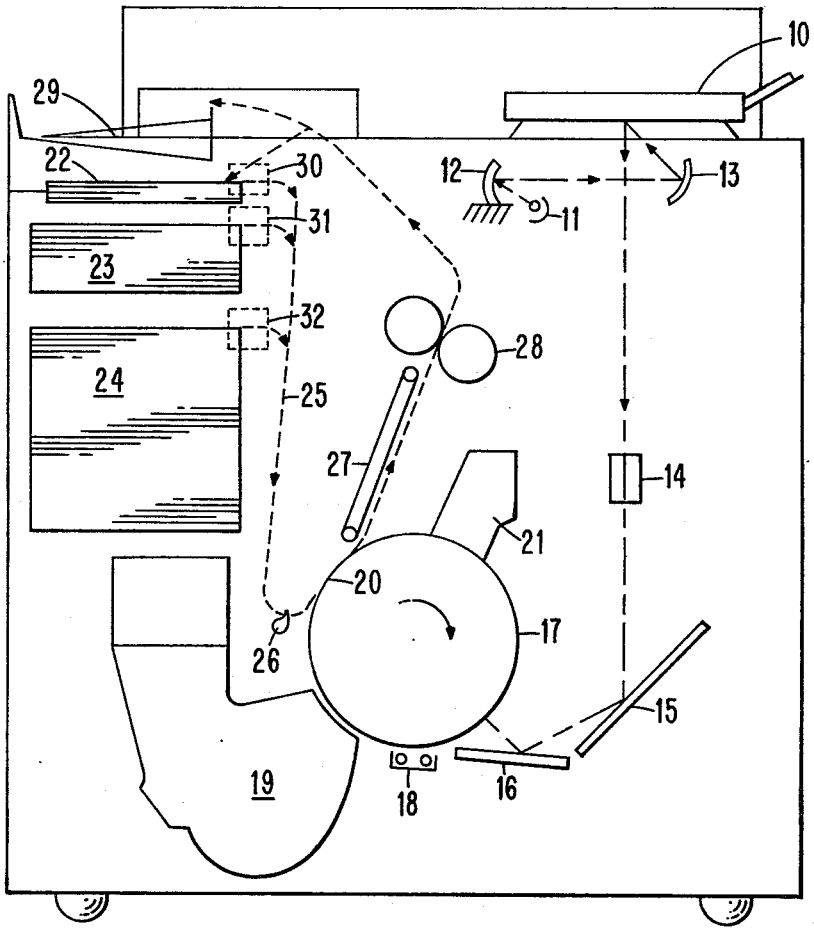
FIG. 1 shows a document copier machine in which the invention has utility.

FIG. 1 is a diagrammatic view of a document copier machine of the transfer type showing the major components of that machine together with the path followed by copy paper. The document to be copied is placed on a transparent glass platen shown generally at 10. The document would be illuminated by a lamp 11 whose rays are transmitted to the document through reflectors 12 and 13. The reflected rays from the document pass through a lens 14 and are reflected by mirrors 15 and 16 to a photoreceptive drum 17. The speed at which mirror 13 scans the original document and at which the drum 17 turns are related so that the photoreceptive material on the drum 17 is caused to carry an image of the document which is in correct proportion to the document.

As the drum 17 turns, the image is passed by an erase lamp 18 which erases that part of the photoreceptive surface which does not carry a part of the desired image and from there to a developer 19 which deposits a developing material onto the photoreceptive surface. This developing material is in turn transferred to the copy paper at the transfer station 20. The continued drum rotation includes a cleaning station 21 where any remaining developing material is wiped away from the photoreceptive surface.

In the particular machine shown in FIG. 1, it is noted that there are three separate paper trays, 22, 23, and 24, each of which can feed paper into the paper path 25. Paper is fed through a gate mechanism 26 at which it is halted until the right moment in the machine cycle at which the paper is released to reach transfer station 20 at the same time as the image. After receiving the image at transfer station 20, the copy paper advances onward by conveyor 27 to fusing rolls 28, where the developing material is fused to the copy paper to form a permanent image thereon. Thereafter, the copy paper continues on to an exit tray 29.

In order to pick one sheet at a time from each of the paper bins, 22, 23, and 24, a paper picking and separating mechanism is associated with each of these bins as shown at 30, 31, and 32. This invention is directed to apparatus for use in reliably separating sheets from these bins and forwarding single sheets to gate 26.

Figure 2:
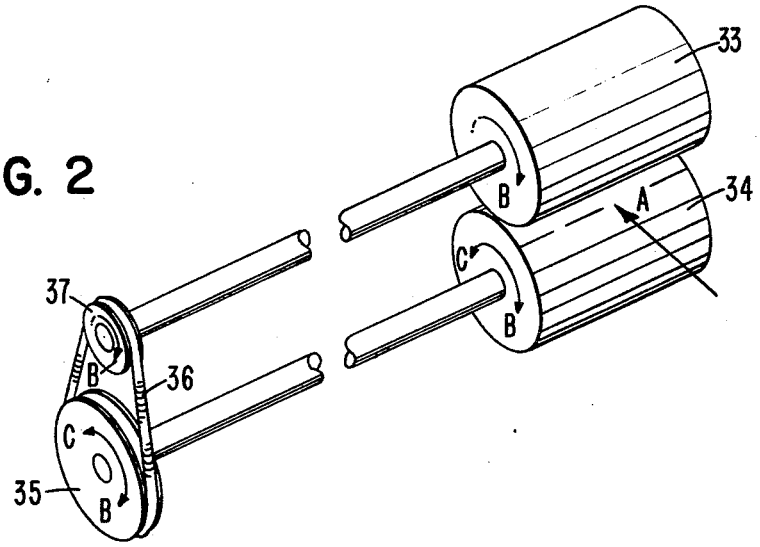
FIG. 2 shows the principle elements of the invention.

FIG. 2 shows the principles of the mechanism employed in the instant invention to separate paper. Suppose that the direction of the paper feed is shown by the arrow A and the separator roller 33 is a positively driven roller rotating in the direction B. Suppose further that roller 34, a retard roll, is not positively driven but acts under the influence of the directional rotation imparted to pulley 35 by a garter spring drive 36 which in turn is moved by the positively driven pulley 37. Therefore, as pulley 37 is turned in direction B, pulley 35 will also turn in direction B, as shown by the arrow. Such motion will result in roller 34 turning in direction B which produces a condition which is anomalous since if rollers 33 and 34 are pressed together, the friction between the two rollers would actually cause retard roller 34 to rotate in direction C. As a consequence, slippage is present in the system and is designed to be a slippage between garter spring 36 and the pulleys 35 and 37, such that without any paper between rollers 33 and 34, roller 33 rotates in direction B, roller 34 in direction C, and slippage occurs between garter spring 36 and the pulleys 35 and 37.

If a single sheet of paper is inserted between rollers 33 and 34, the relative friction between the paper and roller 33 and between the paper and roller 34 does not affect the system and consequently, both rollers 33 and 34 act to move that sheet of paper in direction A. Slippage still occurs between garter spring 36 and the pulleys.

However, if two sheets of paper are inserted between rollers 33 and 34, the relative friction between roller 33 and the top sheet of paper is such as to continue that piece of paper forward in direction A. However, the friction between the surface of roller 34 and the lower sheet of paper is designed to be greater than the friction between the two sheets of paper, such that the bottom sheet of paper will now take the direction imposed on it by the direction of rotation of roller 34. To achieve a movement of the lower sheet of paper opposite to direction A, the relative friction between the two sheets of paper is less than the friction designed into the juxtaposition of garter spring 36 and pulley 35. As a result, pulley 35 turns in direction B and slippage occurs between the two sheets of paper. The bottom sheet is backed out of the nip of the separator rollers since retard roller 34 now turns in direction B, while the upper sheet of paper, as above mentioned, continues to move in the sheet feed direction A. The device works in a similar manner where more than two sheets are fed between the separator rolls.

Figure 3:
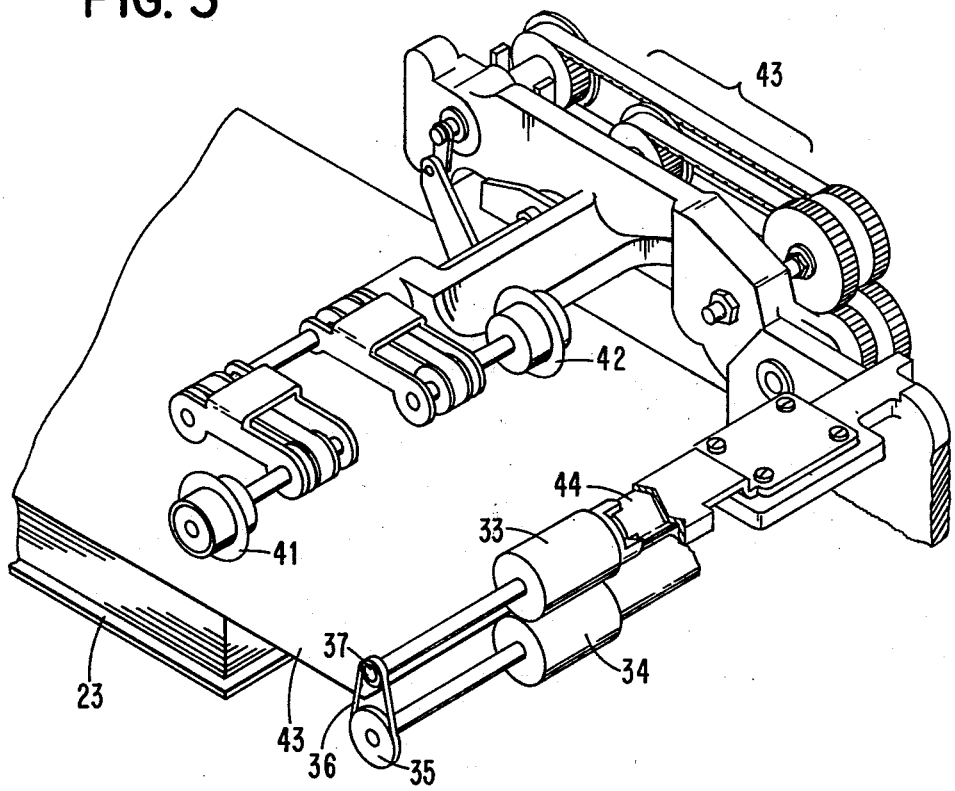
FIG. 3 shows the invention incorporated into an apparatus for use in the machine of FIG. 1.

FIG. 3 shows the incorporation of the device of FIG. 2 into a paper picking and separating mechanism for use in the machine of FIG. 1. The paper bin 23 is shown with a sheet of paper 43 about to enter the nip of the separating rollers 33 and 34. The sheet of paper 40 has been picked from a stack of paper located in paper bin 23 by paper picking rollers 41 and 42. The drive mechanism for transmitting power to picker rollers 41 and 42 is shown generally at 43. This same transmission imparts positive power to separator roller 33 through coupling 44.

The objects of this invention are achieved through the use of garter spring 36 which provides a particularly advantageous mechanism for performance of the actions of retard roll 34. For example, starting from a rest position, as pulley 37 turns in direction B and pulley 35 turns in direction C, coils of the garter spring are added to the slack side and taken from the loaded side of the spring. This process continues until the spring forms a solid column on the slack side, at which instant the initial tension is the only load on the now columnated slack side and the load on the loaded side of the spring is entirely due to the spring extension. Because of the compression of the spring into a solid column on the slack side, slippage then occurs at pulleys 35 and 37 in a completely reliable manner.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. Apparatus for feeding sheets one at a time from a stack of sheets wherein sheet picking and feeding means are employed for moving at least one sheet from said stack and separating means are employed for receiving sheets from said picking and feeding means and rejecting all but one sheet, said separator means comprising:

a positively driven separator roll;

a retard roll located in contact with said separator roll to form a nip therewith;

a first pulley rigidly connected to the shaft of said separator roll;

a second pulley rigidly connected to the shaft of said retard roll; and a continuous garter spring means situated around said first and said second pulleys for allowing said retard roll to rotate in a first direction under the influence of said separator roll due to slippage between said garter spring and at least one of said pulleys, and for driving said retard roll in a second direction when multiple sheets are in said nip, when slippage occurs between said multiple sheets, and when slippage does not occur between said garter spring and the two pulleys.

* * * * *